US010864967B2

(12) United States Patent
Ritz

(10) Patent No.: US 10,864,967 B2
(45) Date of Patent: Dec. 15, 2020

(54) DEVICE FOR ATTACHING A COUPLING DEVICE TO A FREE-FLOATING OBJECT

(71) Applicant: Technische Universität Berlin, Berlin (DE)

(72) Inventor: Sebastian Ritz, Berlin (DE)

(73) Assignee: Technische Universität Berlin, Berlin (DE)

( * ) Notice: Subject to any disclaimer, the term of this patent is extended or adjusted under 35 U.S.C. 154(b) by 0 days.

(21) Appl. No.: 16/331,406

(22) PCT Filed: Sep. 11, 2017

(86) PCT No.: PCT/EP2017/072738

§ 371 (c)(1),
(2) Date: Mar. 7, 2019

(87) PCT Pub. No.: WO2018/050591

PCT Pub. Date: Mar. 22, 2018

(65) Prior Publication Data

US 2019/0202529 A1 Jul. 4, 2019

(30) Foreign Application Priority Data

Sep. 14, 2016 (DE) ..... 10 2016 117 311

(51) Int. Cl.
*B63B 21/20* (2006.01)
*B66C 13/02* (2006.01)
(Continued)

(52) U.S. Cl.
CPC ..... *B63B 21/20* (2013.01); *B63B 21/04* (2013.01); *B63B 27/36* (2013.01); *B66C 1/427* (2013.01);
(Continued)

(58) Field of Classification Search
CPC ..... B63B 21/20; B63B 27/36; B63B 21/04; B66C 23/52; B66C 13/46; B66C 1/62; B66C 1/427; B66C 13/02
(Continued)

(56) References Cited

U.S. PATENT DOCUMENTS 2,876,919 A * 3/1959 True ..... B63B 27/08 414/139.5
2,986,750 A * 6/1961 Herreshoff ..... B63B 23/58 114/368
(Continued)

FOREIGN PATENT DOCUMENTS

DE 605052 11/1934
DE 19745408 A1 4/1999
WO WO-2018050591 A1 3/2018

OTHER PUBLICATIONS

"International Application No. PCT/EP2017/072738, International Search Report and Written Opinion dated Nov. 24, 2017", (dated Nov. 24, 2017), 10 pgs.

*Primary Examiner* — Lynn E Schwenning
(74) *Attorney, Agent, or Firm* — Schwegman Lundberg & Woessner, P.A.

(57) ABSTRACT

A device is proposed for attaching a coupling device to a free-floating object, for example free-floating articles or free-floating persons. The device has: at least one first connection end, which can be connected to a load-receiving end of a lifting device; a coupling device for attachment to a free-floating object; a load-receiving connection between the first connection end and the coupling device; and a guiding device, which is separate from the load-receiving connection, connects the first connection end to the coupling device and is designed to guide the coupling device relative to the first connection end.

17 Claims, 4 Drawing Sheets

(51) Int. Cl.

| | |
|---|---|
| ***B66C 1/42*** | (2006.01) |
| ***B66C 1/62*** | (2006.01) |
| ***B63B 27/36*** | (2006.01) |
| ***B63B 21/04*** | (2006.01) |
| ***B66C 13/46*** | (2006.01) |
| ***B66C 23/52*** | (2006.01) |

(52) U.S. Cl.
CPC ..... *B66C 1/62* (2013.01); *B66C 13/02* (2013.01); *B66C 13/46* (2013.01); *B66C 23/52* (2013.01)

(58) Field of Classification Search
USPC ..... 414/142.7
See application file for complete search history.

(56) References Cited

U.S. PATENT DOCUMENTS

| | | | | |
|---|---|---|---|---|
| 3,401,804 | A | 9/1968 | Link | |
| 3,512,657 | A * | 5/1970 | Chambers | B66C 13/02 414/138.3 |
| 2011/0067619 | A1* | 3/2011 | Pellen | B63B 21/00 114/322 |
| 2014/0377004 | A1* | 12/2014 | Lossec | B66C 13/02 405/3 |

* cited by examiner

DEVICE FOR ATTACHING A COUPLING DEVICE TO A FREE-FLOATING OBJECT

PRIORITY CLAIM TO RELATED APPLICATIONS

This application is a U.S. national stage filing under 35 U.S.C. § 371 from International Application No. PCT/EP2017/072738, filed on 11 Sep. 2017, and published as WO2018/050591 on 22 Mar. 2018, which claims the benefit under 35 U.S.C. 119 to German Application No. 10 2016 117 311.8, filed on 14 Sep. 2016, the benefit of priority of each of which is claimed herein, and which applications and publication are hereby incorporated herein by reference in their entirety.

TECHNICAL FIELD

The present invention relates to a device for attaching a coupling device to a free-floating object, for example free-floating articles or free-floating persons. Such a device can be deployed on a ship or on an offshore structure for example.

BACKGROUND

Watercraft or floating articles are, for example, introduced or launched into the water from the deck of a ship and then recovered again. Such a launch and recovery system (LARS) is generally provided with a coupling device which connects to the watercraft or the floating article so that it can be launched and retrieved by a lifting device connected thereto.

The safe recovery of free-floating objects, such as watercraft or floating devices is made more difficult by the movements of the ship and the free-floating objects relative to each other. The attachment of a crane hook or fastening a comparable coupling device is currently a problem which has not yet satisfactorily resolved. In order to prevent damage through collisions the free-floating article is at a safe distance from the ship. Attaching the coupling device is generally carried out manually, for example by a seaman on the ship who guides the coupling device to the free-floating object with a rod.

Alternatively ships can launch a net or an underwater cage, also known as a garage. The floating device then manoeuvres autonomously into the net or the garage. The floating device is therefore not gripped but is caught and retrieved. However for this suitable manoeuvrability of the floating device is necessary.

Another possibility of recovery is the ejection of a recovery line from the floating device. This rises to the surface and can be caught and brought in with a hook or suchlike from on board the ship. For this the floating device requires a corresponding device for ejecting a recovery line.

In the manual method a coupling device is attached to a free-floating object by a seaman on a ship for example. He often requires several attempts and the work is physically exerting and time-consuming. Moreover, this method is associated with a high risk as the person carrying it out can go overboard or can be hit by swinging loads on the ship, for example by parts of the lifting device.

The special solutions for catching in an underwater cage or recovery using a recovery line place high demands on the floating device to be recovered. There is no reliable general solution for attaching a coupling device to a free-floating object. Furthermore, these solutions are relatively large and heavy and take up much cargo space or loading capacity.

The objective of the present invention is therefore to attach a coupling element to a free-floating object so that it can be recovered by a lifting device.

DESCRIPTION OF THE INVENTION

The aforementioned problem is solved by a device according to claim 1 which can be combined with a winch and frame mounted in a watercraft. Advantageous embodiments are set out in the dependent claims.

According to an embodiment the problem is solved by a guided coupler device (hereinafter DEVICE) for attaching a coupling device to a free-floating object, for example free-floating articles or free-floating persons, comprising: at least one first connection end (e.g., a top plate) a load-receiving (or load-bearing) connection (e.g., a secondary cable or chain) between the first connection end (the top plate) and the coupling device (e.g., a bottom plate with coupler) and a guiding device separate from the load-receiving connection (e.g., the secondary cable or chain) which guiding device also connects the connection end (e.g., the top plate) to the coupling device, (e.g., the bottom plate and coupler) and is configured to increase or decrease the relative dimension between the coupling device (the bottom plate with coupler) and the first connection end (the top plate). The first connection end (e.g., top plate) can be connected to a load-receiving end (e.g., a hook) of a lifting device (e.g., a frame with winch and cable such as a crane).

The guiding device serves to lead the coupling device specifically to a free-floating object, for example free-floating articles, watercrafts, floating devices or persons, and bring about coupling or attaching of the coupling device to the free-floating object. Through attaching the coupling device the object is connected to the lifting device.

Typically the guiding device is functionally separate from the load-receiving connection (the secondary cable or chain). The guiding device can be described as a guiding branch of the DEVICE which forms a connection parallel to a load branch between the first connection end and the coupling device. The term "parallel connection" is to be understood functionally and not geometrically here. The load branch is formed by the load-receiving connection (secondary cable or chain). The guiding device thus forms a "by-pass" to the load-receiving connection.

These two branches allow a functional separation between the functions of carrying of the load by the load-receiving connection and the function of guiding the coupling device to the free-floating object.

The coupling device (e.g., bottom plate with coupler) typically forms a second connection end (e.g. the coupler itself) of the DEVICE The second connection end of the DEVICE is for coupling to the free-floating object. The first connection end (top plate) of the DEVICE is for coupling and connecting to the lifting device (cable and crane).

The load branch, formed by the load-receiving connection (e.g., secondary cable or chain), essentially serves to take up the load of the object coupled to the coupling device. In the simplest case the load-receiving device can be a load cable or rope which is sufficiently dimensioned to take up the load of the object and, for example, to pull the object out of the water. However, the load-receiving connection can also be a chain and in general be formed by a flexible connection element which on the one hand is sufficiently dimensioned in order, in particular, to take up the weight load of the object, and on the other hand allows free linear movement of the coupling device relative to the first connection end.

The load-receiving connection (secondary cable or chain) therefore connects the first connection end (top plate) with the second connection end (bottom plate with coupler). Additionally and typically separately to this, the guiding device also connects the first connection end (top plate) with the second connection end (bottom plate with coupler). The position of the second connection end, i.e. of the coupling device (bottom plate with coupler) relative to the first connection end (top plate) is defined by at least partial control of the guiding device. The guiding device can guide the second guiding end (e.g., bottom plate with coupler) relative to the first guiding end (e.g., top plate).

In this way it is possible to move the coupling device by means of the guiding device to the still free-floating object and bring about coupling of the coupling device with the free-floating object. In contrast to the load-receiving connection, the guiding device does not have to take up or bear the load of the free-floating object. This is taken over by the load-receiving connection (e.g., the secondary cable or chain). The guiding device only has to be configured so that it can safely bear the load, i.e. the weight, of the coupling device and guide the coupling device in a controlled manner to the free-floating object. In this way it is possible to configure the guiding device in a compact and lightweight fashion.

As the guiding device only has to move the coupling device, only relatively small reaction moments (reaction torque) occur. It is therefore possible to move the coupling device relatively quickly so that the coupling device can relatively easily track the free-floating object.

The guiding device allows at least a controlled one-dimensional movement of the coupling device relative to the first connection end. Typically the guiding device is at least configured for a controlled two-dimensional movement of the coupling device relative to the first connection end and preferably for a controlled three-dimensional movement, i.e. in all spatial directions.

The controlled one-dimensional movement of the coupling device relative to the first connection end is generally related to reference system in which the lifting device (cable and crane) rests. If, for example, the first connection end is the end of a crane cable and the DEVICE for attaching a coupling device is fastened thereto, the deflection of the crane cable including the DEVICE is also a controlled movement according to an embodiment.

The guiding device therefore comprises at least one first actuator. This can be configured, for example, to perform a controlled linear movement or rotation. For example, pneumatic linear actuators can be used like pneumatic or hydraulic arms or cylinders as actuators as they have a comparatively low weight and high power to weight ratio. As a result of this, such actuators can also perform relative rapid movements, which is of advantage for the controlled tracking and bringing the coupling device into the proximity of the free-floating object.

Free-floating objects are, in particular, considered to be objects that are not permanently mechanically connected to the lifting device.

Free-floating objects can float on the surface of the water, partially in or completely under the water. They could for example be: manned or unmanned boats or submarines, floating devices or measuring instruments, freight items, boxes, containers, barrels, flotsam or persons. The free-floating objects can weigh from a few kilograms to several tonnes.

Free-floating objects can be manoeuvrable and, for example, have their own propulsion system. However, they can also be non-manoeuvrable. They are subject to the current, the waves and the wind and change their position and location relative to the lifting device and to the coupling device.

Due to a wave movement, for instance, the free-floating object moves. In addition, the lifting device, which is, for example, fastened to or form part of a ship, can also move as a result of the wave movement. Consequently the free-floating object and the lifting device move relative to each other. The amplitude and frequency of this relative movement can fluctuate. Through controlled guiding of the coupling device by the guiding device this relative movement can be countered and the movement of the coupling device harmonised with the movement of the free-floating object, or their movements can at least be aligned. In other words, even if the lifting device and the free-floating object undergo a large movement relative to each other, it can be ensured by the guiding device that the relative movement between the coupling device and the free-floating object is relatively small. This is supported by a guiding device that is light in term of weight.

The guiding device itself does not bear the load of the object, but only the load of the coupling device. Accordingly the guiding device can therefore be configured to be relatively compact. Through this costs can be saved.

For comparison, reference should be made to a solution in which, for example, a robotic arm takes over the attachment and also the lifting of the free-floating object. Accordingly, this robotic arm must therefore be configured in a sturdy manner in order to bear the load of the object. This requirement for the robotic arm results in sluggish movement and does not permit fast movements to be carried out.

In contrast, the guiding device only has to move the coupling device safely. Therefore the guiding device can be equipped with smaller, lighter and more cost-effective components. Furthermore, such a guiding device also allows faster movements so that the guiding device can also follow an object that is moving a great deal due to the wave motion and can move the coupling device to the object better and more reliably.

According to an embodiment the guiding device can assume a configuration known as the park configuration in which the load of the free-floating object is practically entirely taken up by the load-receiving connection, but the guiding device is largely relieved of the load. Through this it is possible that after coupling has taken place the guiding device assumes the park configuration and the load is taken up by the load-receiving connection.

For example, the park configuration can be such that the guiding device is capable of extending to a length which in itself is greater than the length of the load-receiving connection (secondary cable or chain) between the two first and second connection ends (top and bottom plates). If, for example, the adjustable length of the guiding device has a maximum length that is greater than the maximum length of the load-receiving connection, the guiding device can be "relieved" by the maximum length of the load-receiving connection (secondary cable or chain) and then no longer bears any load itself. The coupling device, which is then typically already attached to the objects, is then also borne by the load-receiving connection.

A conceivable possibility is, for example, to implement the guiding device by way of at least one pneumatic or hydraulic arm or cylinder which has a maximum extent that is greater than the maximum extent of the load-receiving connection, for example a cable After coupling has taken place the pneumatic or hydraulic arm or cylinder can be relaxed. Thus through the relaxation of the arm or cylinder, the cable is tensioned but the arm or cylinder pressure is relieved.

Alternatively it is possible for the load-receiving connection to be shortened in order to take up the load of the object including the coupling device and to relieve the guiding device.

The liquid in which the free-floating object is floating can be, for example, salt water, seawater, fresh water, brackish water or also waste water or treated water such as chlorinated water. Objects floating in oil or mixtures of water and oil are also in keeping with the invention. For the sake of simplicity the description relates to free-floating objects in water without being restricted thereto.

According to an embodiment the device for attaching a coupling device can be assembled and disassembled. It can be assembled on a suitable lifting device and also disassembled again and stored. The device can therefore be provided as an add-on kit for lifting devices.

In the simplest case the DEVICE can, for example, be attached to a crane, for example attached to the crane hook with its first connection end. By way of the guiding device, the coupling device is then guided to the free-floating object until coupling takes place. In doing so, movement of the crane hook is not necessary but can take place to support coupling. After completed coupling either the length of the load-receiving connection is shortened or the guiding device assumes its park configuration. As a result the load-receiving connection is tensioned and the crane hook lifted. Through this the now coupled object can be lifted and recovered.

After recovery has taken place the device can be disassembled and stored.

The coupling device can be attached to the object and couple it. The coupling device is then connected to the object in a load-receiving manner. The coupling device is adapted to the floating object and can comprise, for example, a hook, a carabiner, a loop, a ring, a circular or cylinder coupling, a mushroom head lock, a gripper or a net. Depending on the type of coupling device attachment of the coupling device involves, for example, hooking, snapping in, threading in, encompassing, coupling, docking, gripping or entrapping.

According to an embodiment the coupling device has a securing mechanism which prevents unintentional detachment from the object after attachment. The securing mechanism can be self-locking when the coupling device comes into contact with the object. A securing mechanism is configured in such a way that it can only be opened by deliberate unlocking.

The securing mechanism can for example be a snap lock on a carabiner or a mushroom head lock.

According to an embodiment the guiding device can bear the load of the coupling device with an object coupled thereto.

According to an embodiment the load of the load-receiving connection is a multiple of that of the guiding device. The load of the load-receiving connection can, for example, be more than 5 times or more than 10 times the load of the guiding device.

The device attaches a coupling device to a free-floating object so that a load-receiving end of a lifting device is connected with the object. The lifting device is configured in such a way that it bears the dynamic tensile load of the object.

The lifting device can be configured so that it can lift or pull the object out of the water. According to an embodiment the lifting device can be a crane, a lifting or traction winch or similar. The load bearing capacity of such a lifting device corresponds to the force with which a mass of several hundred kilograms or several tonnes pulls on the lifting device in heavy seas.

According to an embodiment the load bearing capacity of the lifting device is at least 1 t or at least 5 t or at least 10 t.

The DEVICE for attaching a coupling device comprises a least one first connection end (e.g., top plate) which can be connected to a load-receiving end (e.g., hook) of a lifting device (e.g., crane with cable). The load-receiving end of the lifting device is configured in such a way that it can be connected to the first connection end of the DEVICE for attaching a coupling device. According to an embodiment the load-receiving end of the lifting device is, for example, a hook, an eye, a plate or the end of a stable rope or cable.

As has already been described above, the DEVICE for attaching a coupling device comprises a load-receiving connection (secondary cable or chain) between the first connection end (top plate) and the coupling device (bottom plate with coupler). The load-receiving connection is configured so that it bears the tensile load of the object in the water. The load-receiving connection can be configured so that it bears the load that is required to lift or pull the object out of the water.

The load-receiving connection is not loaded when it is not bearing a load of an object. The load-receiving connection is loaded when it is bearing the load of an object.

The load-receiving end of the lifting device (e.g., hook on cable of crane), the first connection end, the load-receiving connection and the coupling device form the load branch which can bear the dynamic tensile load of the object. The load branch is not loaded when the coupling unit (e.g., the coupler itself) is not connected to an object. The load branch is loaded when the coupling unit is coupled with one or more objects and the load of the object or the objects is taken up by the load branch.

According to an embodiment the guiding device is separate from the load-receiving connection and also connects the first connection end of the DEVICE with the coupling device. The guiding device is configured in such a way that it can guide the coupling device relative to the first connection end (i.e., increase or decrease the dimension between the top plate and bottom plate with coupler). Preferably the guiding device is therefore separate from the load-receiving connection and connects the first connection end of the device to the coupling device. According to an embodiment the guiding device is parallel to the load-receiving connection.

According to an embodiment the guiding device guides the coupling device when the loading branch is not loaded. This can take place in one or more spatial dimensions.

The range of movement within which the guiding device can move the coupling device defines a catching area for the free-floating object. Though the guiding of the coupling device by the guiding device the free-floating object can be caught and coupled in the catching area.

According to an embodiment the guiding device is configured in such a way that it can increase or decrease the distance between the first connection end (top plate) and the coupling device (bottom plate with coupler). The guiding device can be configured so that through increasing the distance from (e.g., dimension between) the first connection end of the DEVICE to the coupling device, it loads the load-receiving connection after coupling the coupling device to the object. In doing so, the guiding device can assume the aforementioned park configuration.

According to another embodiment the guiding device may be configured in such a way that it can move the coupling device in a horizontal plane, i.e. a plane which is essentially parallel to the surface of the water. The coupling device is then guided relative to the first connection end. The lifting device rests in the reference system of the relative movement.

BRIEF DESCRIPTION OF THE FIGURES

The invention will be described below in more detail by way of the examples of embodiment, without being restricted thereto. The attached figures only show schematic drawings and are not to scale.

DETAILED DESCRIPTION OF EMBODIMENTS

Figure 1A:
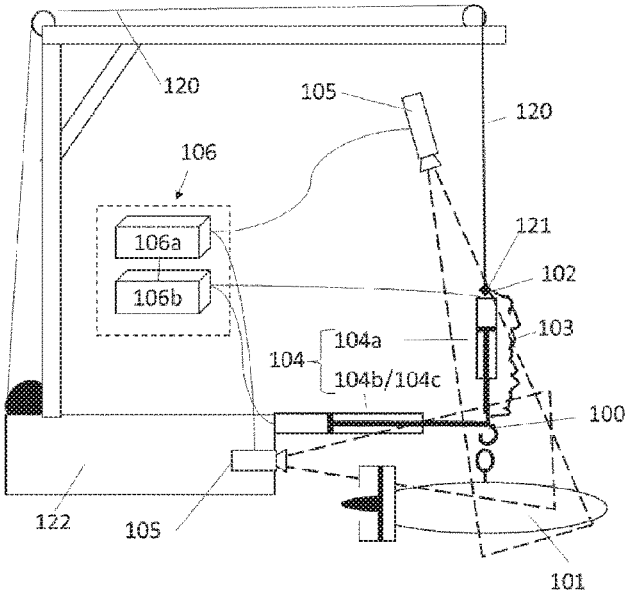
FIGS. 1A and 1B show a side view and view from above of an embodiment of the invention.
Figure 1B:
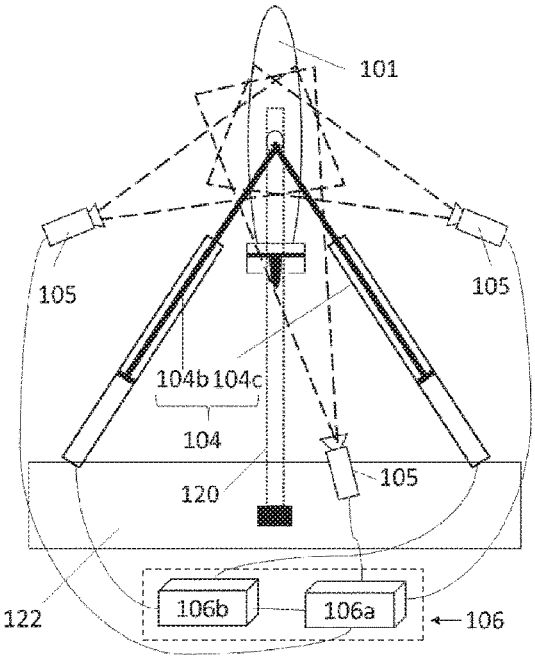

According to an embodiment FIGS. 1A and 1B show a DEVICE for attaching a coupling device 100 (e.g., bottom plate with underside coupler) to a free-floating object 101, for example free-floating articles or free-floating persons, comprising: at least one connection end 102 (e.g., top plate) which can be connected on its topside to a load-receiving end 121 (e.g., hook) of a lifting device 120 (e.g., cable and crane), a load-receiving connection 103 (e.g., secondary cable or chain) between the first connection end 102 (e.g., top plate) and the coupling device 100 (e.g., bottom plate with underside coupler), and a guiding device 104 (e.g., system of pneumatic or hydraulic cylinders) separate from the load-receiving connection 103 (e.g., secondary cable or chain) and which guiding device connects the connection end 102 (e.g., top plate) to the coupling device 100 (e.g., bottom plate with underside coupler) and is configured to guide the coupling device 100 relative to the connection end 102.

According to an embodiment the connection (DEVICE) for attaching a coupling device 100 to a free-floating object 101, for example free-floating articles or free-floating persons comprises: at least one first connection end 102 which can be connected to a load-receiving end 121 of a lifting device 120, a load-receiving connection 103 between the first connection end 102 and the coupling device 100, and a guiding device 104 separate from the load-receiving connection 103 which connects the connection end 102 with the coupling device 100 and is configured to guide the coupling device 100 relative to the first connection end 102 when the load-receiving connection 103 is not loaded.

According to an embodiment the lifting device 120 is fastened to a base 122. The base 122 of the lifting device 120 can be part of a watercraft or an off-shore structure or fixed in the vicinity of a waterway.

According to an embodiment the base 122 of the lifting device 120 is part of a ship. The lifting device 120 can be the A-frame of the ship or a crane.

The guiding device 104 can move the coupling device 100 in at least one and possibly in two or three spatial dimensions. The guiding device 104 guides the coupling device 100 relative to the first connection end 102 (e.g., guiding the vertical distance between the top plate and the bottom plate with underside coupler).

The guiding device can guide the position of the coupling device 100. According to an embodiment the guiding device 104 can also change the location of the coupling device 100 relative to the object 101 (e.g., guiding the horizontal distance between the DEVICE and the object).

According to an embodiment the guiding device 104 is configured in such a way that it can vary the distance between the first connection end 102 and the coupling device 100. The guiding device 104 can be configured such that, through the variation in the distance from the first connection end 102 of the device to the coupling device 100, it loads the load-receiving connection 103 after coupling the coupling device to the object.

The guiding device 104 shown in FIGS. 1A and 1B comprises several linear actuators 104*a*, 104*b*, 104*c*. The first linear actuator 104*a* is arranged vertically to the surface of the water and connects the coupling unit 100 to the first connection end 102 of the device separately from the load-receiving connection 103. The second linear actuator 104*b* and the third linear actuator 104*c* are arranged horizontally in relation to the surface of the water. The horizontal actuators connect the coupling unit 100 to the first connection end 102 separately from the load-receiving connection 103 via the base of the lifting device 122 and the lifting device 120.

According to an embodiment the guiding device 104 comprises at least one first linear actuator 104*a* which connects the connection end (e.g., top plate) to the coupling device (e.g., bottom plate with underside coupler).

According to an embodiment the guiding device 104 comprises at least one second linear actuator 104*b* with a first and a second end, wherein the first end forms a second connection end of the guiding device for attaching the guiding device relative to the lifting device 120 (e.g. cable and crane) and the second end is connected to the coupling device 100 (e.g., bottom plate with underside coupler).

According to an embodiment the guiding device 104 comprises at least two linear actuators 104*b*, 104*c* each with a first and a second end, wherein the first end of each linear actuator is attachable relative to the lifting device 120 and the second end of each linear actuator is connected to the coupling device 100.

Linear actuators can be selected from a group comprising: pneumatic or hydraulic arms or cylinders, linear motors, stepper motors or combinations thereof.

Pneumatic linear actuators, for example pneumatic arms or cylinders can be deployed on ships as ships often already have a suitable pneumatic system, for example a conventional compressed air supply.

Depending on their inherent stability, for the pneumatic or hydraulic arms or cylinders a support device, consisting of telescopic pipes for example, may be required.

According to an embodiment the guiding device 104 has a robotic arm which can guide the coupling device 100. This robotic arm can comprise a plurality of movable axes. For example, this robotic arm is a pick-and-place robot.

According to an embodiment the device for attaching a coupling device 100 to free-floating object 101 has a recording device 105. The recording device 105 is configured so that it can determine the position of an object 101 or its location or both. The object 101 moves in the water through its own movement and the sea swell.

The position of the object 101 can, for example, be determined relative to the coupling device 100, relative to the lifting device 120 or relative to the base 122 of the lifting device.

The recording device 105 is configured in such a way that it can determine the position of the object or the location of the object or both. According to an embodiment the recording device 105 is configured in such a way that it can determine the position of the coupling device 100. From this the position of the object relative to the coupling device 100 can be determined.

According to an embodiment the recording device comprises one or more optical sensors for recording the position of the free-floating object. Optical sensors can, for example, be cameras in the optical or infrared range.

Through image evaluation of the optical sensors the position of the free-floating object in the catching area is determined. The position of the coupling device can be known or also determined in order to determine the relative position and/or location between the free-floating object and the coupling device therefrom. The control device 106 then controls guiding device in such a way that the guiding device guides the coupling device to the free-floating object. The object can then be attached.

When the object is attached it can be recovered by the load branch of lifting device, load-receiving connection and coupling device.

According to an embodiment the device for attaching a coupling device to a free-floating object has a control device 106 for controlling the guiding device 104. The control device 106 is connected to the recording device 105 in such a way that it can process the recorded position of the free-floating object 101 and, if necessary, the position of the coupling device 100.

The position of the free-floating object 101 can be determined in the recording device 105 and forwarded to the control device 106. According to an embodiment the recording device 105 and control device 106 are combined in a joint component.

According to an embodiment the control device 106 is in two parts. The first part of the control device 106*a* is suitable for processing the data of the recording device and producing a movement forecast of the object 101 and/or the coupling device 100. The second part of the control device 106*b* controls the guiding device.

According to an embodiment in the control device the position and/or the location of the free-floating object and, as the case may be, the position and/or location of the coupling device are processed. In addition a forecast of the movement and future position and/or location of the object and/or the coupling device can be established. From this, software-based regulation (closed-loop control) of the guiding device can be set up.

According to an embodiment the control device controls the guiding device mechanically. This takes place on the basis of the regulation. The mechanical controlling of the guiding device is dependent on the type of guiding device and includes, for example, the application of a voltage to operate an electric motor or the opening and/or closing of pressure valves of a pneumatic or hydraulic device.

According to an embodiment the control device controls the guiding device in such a way that when the load-receiving connection is not loaded the guiding device guides the coupling device to the free-floating object in dependence on the position recorded by the recording device.

According to an embodiment the regulation and the mechanical control of the guiding device by the control device takes place automatically when the free-floating object is within the reach of the coupling device.

Figure 2A:
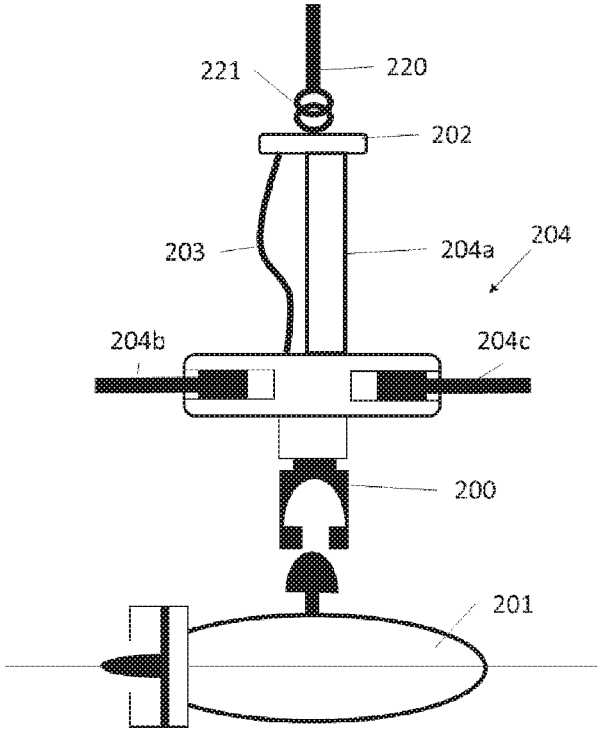
FIGS. 2A and 2B show a form of embodiment of the invention with the loaded and not loaded load-receiving connection.

FIG. 2A shows a load-receiving end 221 of a lifting device 220. The load-receiving end 221 is connected to a first end 202 (e.g., top plate) of a DEVICE for attaching a coupling device 200 (e.g., bottom plate with underside coupler) to a free-floating object 201. In addition, the DEVICE comprises a load-receiving connection 203 (e.g., secondary cable or chain) between the first connection end 202 and the coupling device 200 and a guide device 204 separate from the load-receiving connection 203 which connects the connection end 202 to the coupling device 200 and is configured to guide the coupling device 200 relative to the first connection end 202.

Figure 2B:
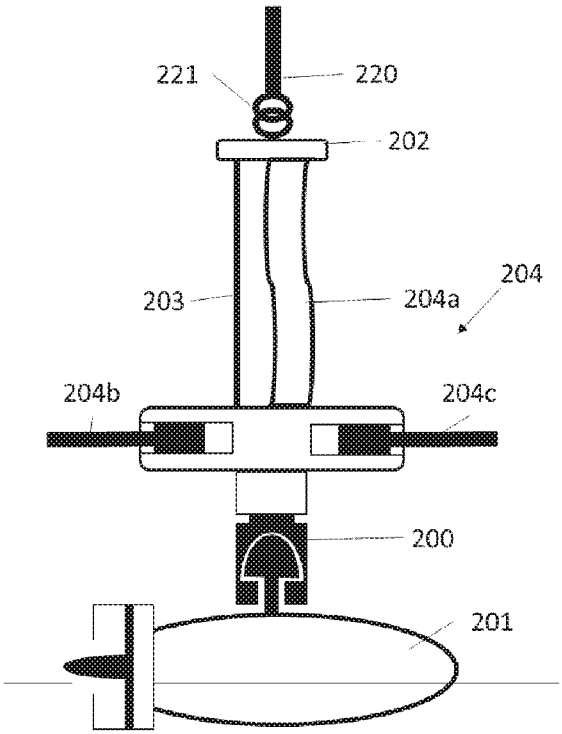

According to an embodiment the guiding device 201 in FIGS. 2A and 2B comprises at least one first linear actuator 204*a*. The first linear actuator 204*a* is vertically arranged and can increase or decrease the distance between the first connection end 202 and the coupling device 200. Through this the load-receiving connection 203 is loaded or unloaded. The guide device 204 also has at least one second linear actuator 204*b* with a first and a second end, wherein the first end forms a second connection end for attaching the guide device to the lifting device 220 and the second end is connected to the coupling device 200 (e.g., bottom plate with underside coupler).

Furthermore, the guide device 204 in FIGS. 2A and 2B comprises at least two linear actuators 204*b*, 204*c* each with a first and a second end, wherein the first end of each linear actuator is attachable relative to the lifting device and the second end of each linear actuator is connected to the coupling device 200. These are both horizontal linear actuators.

According the embodiment in FIGS. 2A and 2B all three linear actuators 204*a*, 204*b*, 204*c* have pneumatic cylinders or pneumatic arms or hydraulic arms or cylinders.

Figure 2C:
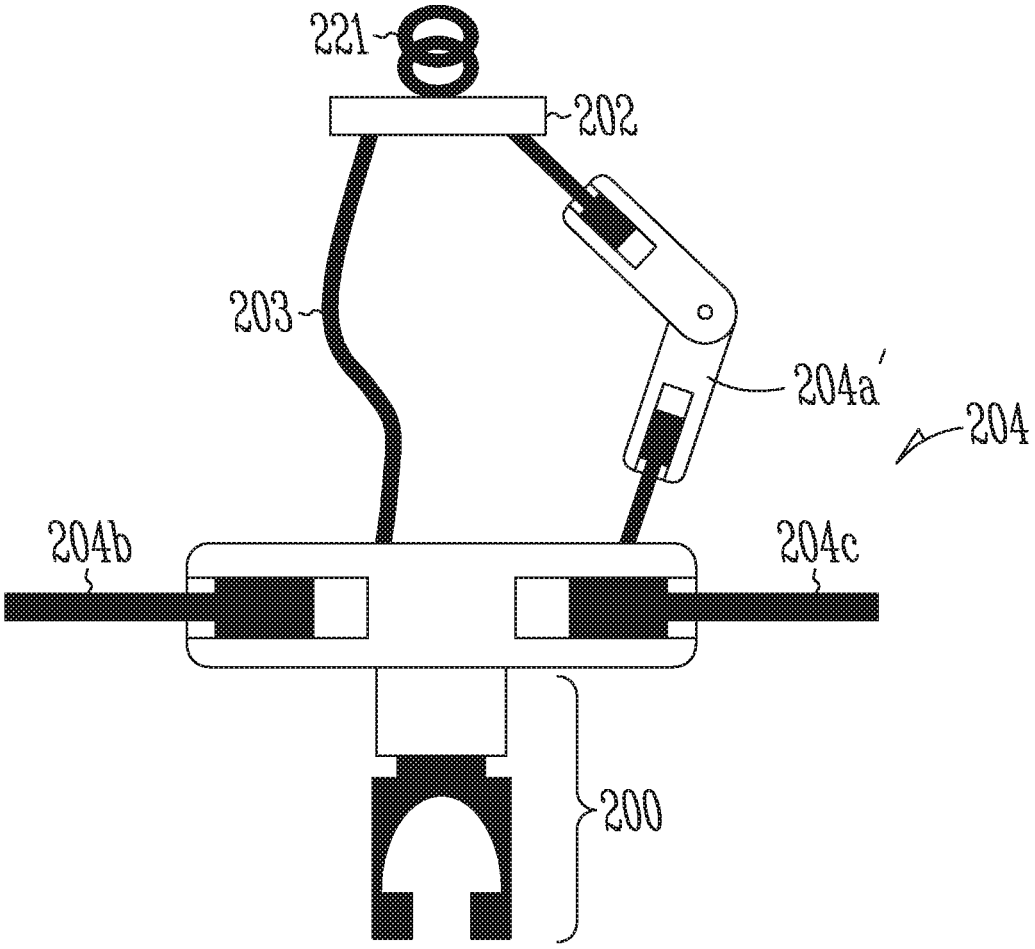
FIG. 2C shows the embodiment of FIG. 2A with vertical linear actuator 204*a* revised to be an articulated mechanical pneumatic or hydraulic arm.

According to an embodiment the guiding device comprises at least one or at least two articulated arms which each have a first and a second end. The articulated arms are constructed of pneumatic or hydraulic arms or cylinders and supporting telescoping pipes according to the construction of the guiding device. The articulation provides joints for multiple moving telescoping pipes. The arrangement of the articulated pneumatic or hydraulic arms relative to the DEVICE follows the arrangement for the guiding device. The first end of a vertical articulated pneumatic or hydraulic arm is connected to the first connection end (e.g. top plate) and the second end of vertical articulated arm is connected to the coupling device (e.g., bottom plate with underside coupler). The first end of a horizontal articulated pneumatic or hydraulic arm is connected to the lifting device (e.g., frame of crane) and the second end is connected to the coupling device. The articulated arms allow a one-dimensional or multi-dimensional freedom of movement of the coupling device through the guiding device. FIG. 2C shows the embodiment of the DEVICE depicted and number according to FIG. 2A and the foregoing description of FIG. 2A except that the vertical linear actuator 204*a* of FIG. 2A is reconfigured to be an articulated mechanical pneumatic or hydraulic arm 204*a'*.

According to the form of embodiment in FIGS. 2A and 2B the coupling device 200 has a mushroom head lock and the free-floating object 201 the corresponding counterpart so that the coupling device 200 can couple to the free-floating object 201.

FIG. 2A shows the device for attaching coupling device 200 to a free-floating object 201 before attaching the coupling device 200. The guiding device 204 guides the coupling device 200 to the free-floating object 201. The vertical arm or -cylinder 204*a* guides the coupling device 200 to the free-floating object 201. The vertical arm or cylinder 204*a* is part of the guiding device 204. In FIG. 2A it is contracted and reduces the distance between the first connection end 202 and the coupling device 200. The load branch formed of the lifting device 220, first connection end 202, load-receiving connection 203 and coupling device 200 is not loaded.

FIG. 2B shows the device for attaching a coupling device 200 to a free-floating object 201 after coupling on the coupling device 200. The object 201 is now coupled and no longer free-floating. The vertical arm or cylinder 204*a* is not contracted and in comparison with FIG. 2A increases the distance between the first connection end 202 and the coupling device 200. The load branch formed of the lifting device 220, first connection end 202, load-receiving connection 203 and coupling device 200 is loaded. In particular, the load-receiving connection 203 is loaded with the load of the coupled object 201.

Figure 3:
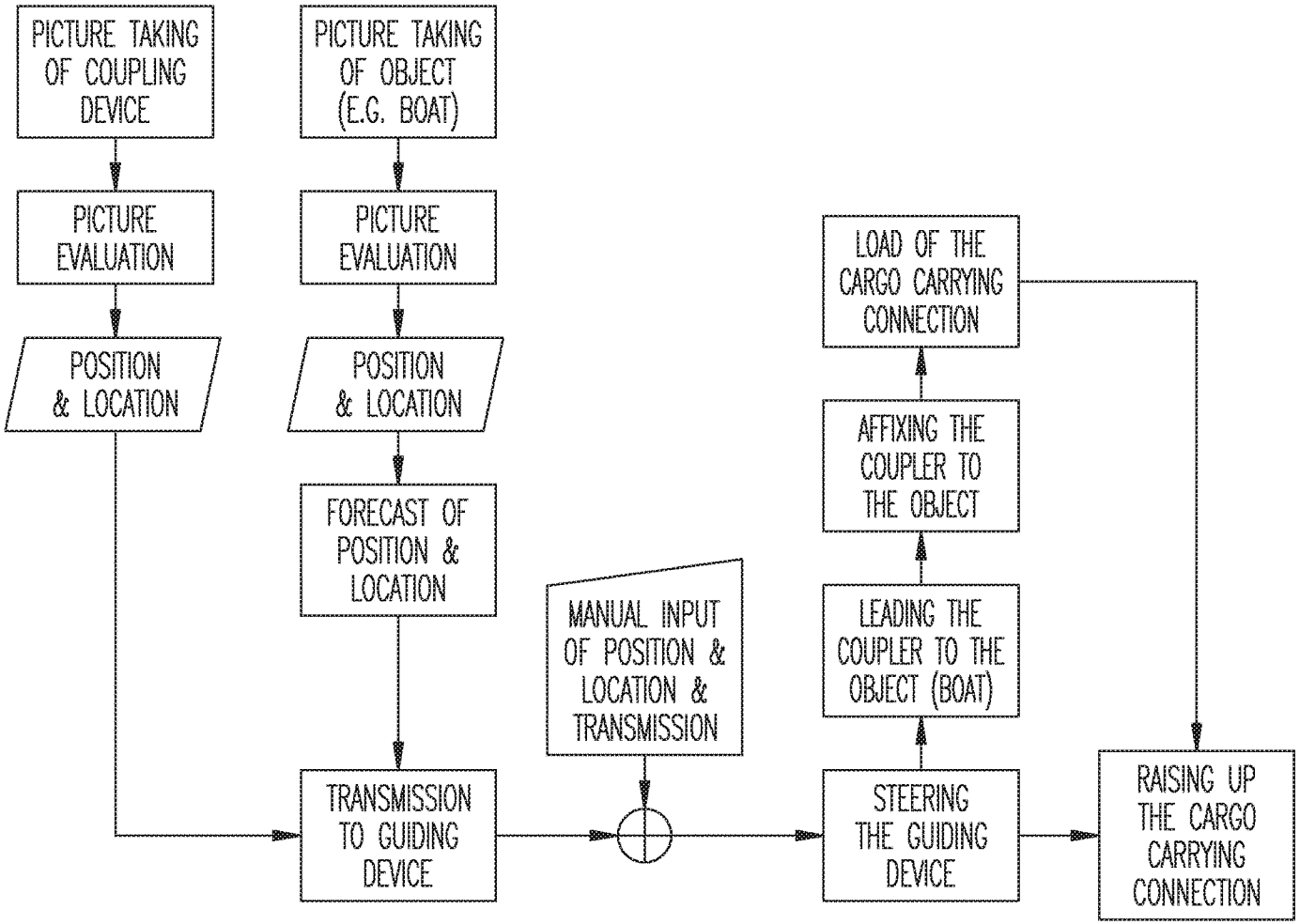
FIG. 3 shows a flow diagram for controlling a form of embodiment of a device for attaching a coupling device to a free-floating object.

FIG. 3 shows a flow diagram for operating a form of embodiment of a device for attaching a coupling device to a free-floating object. In this form of embodiment the recording device is configured in such a way that is can produce image recordings both of the coupling device and also the object. Through the subsequent image evaluation, the position and location of the coupling device and of the object are determined in parallel. Assisted by computer a forecast can be produced for the position and location of the object from the current movement. On the basis of this computer-assisted regulation of the guiding device takes place.

The position of the free-floating object can, according to an embodiment, be determined by way of a motion capture method. In this the object and the coupling device are provided with optical markers. The markers are recorded by optical cameras of the recording device and processed in the recorded images. By way of the marker movements in the individual camera images the position and/or location of the markers can be calculated in 3D using triangulation. Alternatively the markers can be dispensed with if the object or the coupling device can be tracked by pattern recognition.

According to an embodiment image recording, image evaluation, determination of the position and location, forecasting the position and location and regulation of the guiding device take place in a common component. This component then comprises at least parts of the recording device as well as at least parts of the control device.

Alternatively the position and the location of the object can be recorded manually, for example by a seaman on board the ship. Regulation can also take place manually by a way of a type of joystick or other suitable input device. The seaman then regulates/controls the guiding device while he is observing the object and the coupling device.

According to the form of embodiment in FIG. 3 the control device mechanically controls the guiding device. In doing so it converts the instructions by the regulation into mechanical actions. The guiding device then guides the coupling device to the object. After the coupling device has been attached the load-receiving connection can be loaded with the load of the object. Finally the object can be lifted via load-receiving connection by the lifting device.

According to an embodiment the device for attaching a coupling device is dismantled and is only connected to a lifting device when required. The dismantled device for attaching a coupling device is stored on board a ship and is fastened to a lifting device when required. The device for attaching a coupling device can, for example, be stored in a shipping container.

Further forms of embodiment are produced through various combinations of a lifting device and a device for attaching a coupling device as described in the previous sections. The lifting device has a load-receiving end which can be connected to the first connection end of the device.

A lifting device with a load receiving end can, for example, have a hook on which the device for attaching a coupling device can be suspended.

Further forms of embodiment are brought about in a watercraft with a lifting device and a device for attaching a coupling device through various combinations of the forms of embodiment of the device as described above.

According to an embodiment the lifting device of the watercraft can be connected to the device for attaching a coupling device. To use the device for attaching a coupling device the lifting device is connected to the device for attaching a coupling device.

The lifting device of the watercraft can be a crane or an A-frame for example.

The invention claimed is:

1. A device for attaching a coupler to an object floating on a body of water, comprising:

a top plate having upper- and under-sides and having on its upper side a connecting receptacle suitable for attaching a primary cable of a winch in a frame, a bottom plate having upper- and under-sides and having attached on its underside the coupler, a length of secondary cable or chain connected to the under-side of the top plate and the upper-side of the bottom plate, a guiding device comprising at least one vertical linear actuator connected to the under-side of the top plate and the upper-side of the bottom plate, wherein the at least one vertical linear actuator is capable of linear expansion and contraction to increase and/or decrease the dimension between the top and bottom plates, the maximum expansion of the at least one vertical linear actuator being greater than the maximum length of the secondary cable or chain, and the at least one vertical linear actuator being separate from the secondary cable or chain.

2. A device according to claim 1 wherein the length of the secondary cable or chain is adjustable.

3. A device according to claim 1 further comprising at least one recording device and a computer, wherein the recording device, computer and guiding device are electronically connected, the recording device obtains optical images of the object and coupler, converts the optical images to electronic signals indicating the position and location of the object and the coupler and sends the electronic signals to the computer, and the computer is loaded with software to: a) receive the electronic signals from the recording device, b) use the electronic signals to evaluate the positions of the coupler and the object, c) forecast movements of the object and d) operate the guiding device to position the coupler at the position of the object.

4. A device according to claim 3 wherein the recording device comprises optical sensors.

5. A device according to claim 4 comprising at least three optical sensors positioned to triangulate the positions of the coupler and the object.

6. A device according to claim 1 wherein the at least one vertical linear actuator is selected from the group consisting of one or more of a pneumatic arm, a pneumatic cylinder, a hydraulic arm, a hydraulic cylinder, a linear motor, a stepped motor and combinations thereof.

7. A device according to claim 1 wherein the guiding device further comprises at least one horizontal linear actuator having first and second ends, the first end being attachable to the frame and the second end being attached to the bottom plate.

8. A device according to claim 7 comprising at least two horizontal linear actuators.

9. A device according to claim 8 wherein the linear actuators are selected from the group consisting of one or more of a pneumatic arm, a pneumatic cylinder, a hydraulic arm, a hydraulic cylinder, a linear motor, a stepped motor and combinations thereof.

10. A device according to claim 9 wherein the linear actuators include telescoping pipes as supports.

11. A device according to claim 10 wherein at least one linear actuator and telescoping pipe are formed into an articulated mechanical pneumatic or hydraulic arm.

12. A device according to claim 1 wherein the coupler includes a securing mechanism for preventing unintentional detachment of the coupler from the object after attachment of the coupler to the object.

13. A device according to claim 1 wherein the coupler comprises a hook, a carabiner, a loop, a ring, circular or cylinder coupling, a mushroom head lock, a ring, a loop, a gripper or a net.

14. A device according to claim 1, further comprising the frame with the winch and primary cable and the connecting receptacle of the device is attached to the primary cable.

15. A device according to claim 14 wherein the frame with winch and primary cable are a crane with the primary cable.

16. A device according to claim 14 wherein the frame with winch and primary cable are mounted in a watercraft.

17. A device according to claim 15 wherein the frame with winch and primary cable are the crane mounted in a watercraft.

* * * * *